US008313303B2

(12) United States Patent
Christofi et al.

(10) Patent No.: US 8,313,303 B2
(45) Date of Patent: Nov. 20, 2012

(54) ACOUSTICAL VIBRATION DAMPENER FOR A ROTATABLE BLADE

(75) Inventors: Costas Christofi, Flint, TX (US); Quynh Hoang, Tyler, TX (US); Sanjay Gupta, Tyler, TX (US); Angus Lemon, Tyler, TX (US); James T. Vershaw, Tyler, TX (US); Nandagopal Nalla, Tyler, TX (US); Emile Abi-Habib, Tyler, TX (US)

(73) Assignee: Trane International Inc., Piscataway, NJ (US)

( * ) Notice: Subject to any disclaimer, the term of this patent is extended or adjusted under 35 U.S.C. 154(b) by 823 days.

(21) Appl. No.: 12/169,194

(22) Filed: Jul. 8, 2008

(65) Prior Publication Data

US 2010/0008791 A1 Jan. 14, 2010

(51) Int. Cl.

| | |
|---|---|
| ***B63H 1/26*** | (2006.01) |
| ***B63H 7/02*** | (2006.01) |
| ***B64C 11/24*** | (2006.01) |
| ***B64C 27/46*** | (2006.01) |
| ***B64C 11/16*** | (2006.01) |
| ***F01D 5/18*** | (2006.01) |
| ***F01D 5/14*** | (2006.01) |
| ***F03B 3/12*** | (2006.01) |
| ***F03B 7/00*** | (2006.01) |
| ***F03D 11/02*** | (2006.01) |
| ***F03D 29/38*** | (2006.01) |

(52) U.S. Cl. ..... 416/241 R; 416/224

(58) Field of Classification Search ..... 416/224
See application file for complete search history.

(56) References Cited

U.S. PATENT DOCUMENTS

| | | | | |
|---|---|---|---|---|
| 2,425,088 | A | 8/1947 | Dean | |
| 3,373,930 | A | 3/1968 | Rom | |
| 3,773,435 | A | 11/1973 | Wooden | |
| 5,141,400 | A | 8/1992 | Murphy et al. | |
| 5,486,096 | A | 1/1996 | Hertel et al. | |
| 5,725,355 | A | 3/1998 | Crall et al. | |
| 6,287,664 | B1 | 9/2001 | Pratt | |
| 6,669,447 | B2 * | 12/2003 | Norris et al. | 416/224 |
| 6,712,584 | B2 | 3/2004 | Zeng | |
| 6,814,545 | B2 | 11/2004 | Hext, III et al. | |
| 2009/0297359 | A1 * | 12/2009 | Shah et al. | 416/241 R |
| 2009/0317236 | A1 * | 12/2009 | Hardwicke | 415/119 |

OTHER PUBLICATIONS

Christofi, Costas; U.S. Appl. No. 12/163,397; Title "Structural and Acoustical Vibration Dampener for a Rotatable Blade"; filed Jun. 27, 2008; Specification 16 pages; 9 Drawing Sheets (Figs. 1A-1B, 2A-2B, 3A-3B, 4A-4B, and 5).

* cited by examiner

*Primary Examiner* — Fernando L Toledo
*Assistant Examiner* — Valerie N Brown
(74) *Attorney, Agent, or Firm* — Conley Rose, P.C.; J. Robert Brown, Jr.

(57) ABSTRACT

An acoustical vibration dampening system for a rotatable blade comprises at least one section of a rotatable blade and a layer of acoustic damping material coupled to a portion of the at least one section of a rotatable blade. A fan blade comprises a first structural section of a fan blade, a second structural section of the fan blade, and a layer of acoustic damping material provided between the first structural section and the second structural section of the fan blade. A method of making a fan blade with acoustic damping comprises forming at least two sections of a fan blade, and disposing an acoustical vibration dampener between the at least two sections of the fan blade.

21 Claims, 4 Drawing Sheets

ACOUSTICAL VIBRATION DAMPENER FOR A ROTATABLE BLADE

CROSS-REFERENCE TO RELATED APPLICATIONS

No Applicable.

STATEMENT REGARDING FEDERALLY SPONSORED RESEARCH OR DEVELOPMENT

Not Applicable.

BACKGROUND

A typical fan includes a cylindrical hub body with a rotatable blade assembly coupled thereto. The rotatable blade assembly includes a spider with a plurality of arms extending outwardly from a cylindrical central portion connected to the hub body and a plurality of rotatable blades attached to the spider arms. One end of a cylindrical rod, or driveshaft, is disposed within an axial bore through the hub and coupled to the hub body using a set screw or other connection device. A drive unit, such as an electric motor, is coupled to the other end of the driveshaft and operates to transfer power to the hub body in the form of torque by rotating the driveshaft. Due to the coupling of the driveshaft to the hub, and the hub to the blade assembly, rotation of the driveshaft imparts rotation to the hub body and the blades. Also, due to the coupling of the driveshaft to the hub, and the hub to the blade assembly, mechanical and acoustical vibration energy that is generated in the drive unit is transmitted to the rotatable blades. Vibration energy may also be created by uneven air flow/pressure distributions in which the fan is operating. Rotation of the blades may produce undesirable audible noise, and may also lead to vibration-induced material fatigue failure of the fan.

SUMMARY OF THE DISCLOSURE

An acoustical vibration dampener for a rotatable blade is disclosed. In an example embodiment, an acoustical vibration dampening system for a rotatable blade is disclosed with at least one section of a rotatable blade, and a layer of acoustic damping material coupled to a portion of a surface of the at least one section of the rotatable blade.

In a second example embodiment, a fan blade is disclosed with a first structural section of a fan blade, a second structural section of the fan blade, and a layer of acoustic damping material provided between the first structural section and the second structural section of the fan blade.

In a third example embodiment, a method of making a fan blade with acoustic damping is disclosed. The method forms at least two sections of a fan blade, and disposes an acoustical vibration dampener between the at least two sections of the fan blade.

Thus, the acoustical vibration dampener and associated methods comprise a number of features. The various characteristics described above, as well as other features, will be readily apparent to those skilled in the art upon reading the following detailed description of the embodiments of the disclosure, and by referring to the accompanying drawings.

BRIEF DESCRIPTION OF THE DRAWINGS

For a more detailed description of the various embodiments of the acoustical vibration dampener for a rotatable blade, reference will now be made to the accompanying drawings, wherein.

DETAILED DESCRIPTION

Figure 1A:
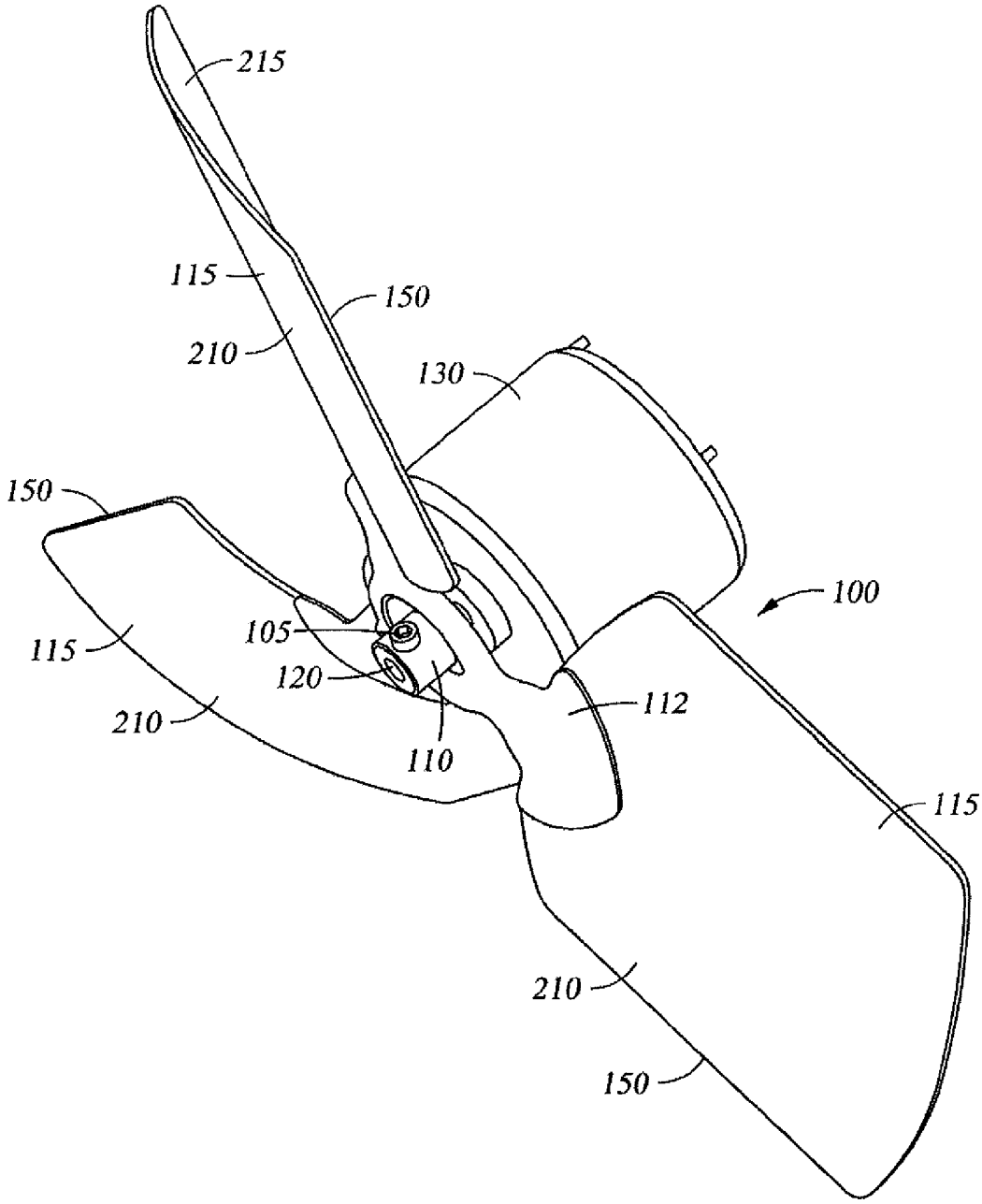
FIG. 1A is a schematic perspective view of a fan assembly comprising a representative embodiment of a rotatable blade incorporating an acoustical vibration dampener in accordance with the principles disclosed herein.

This application is related by subject matter to commonly-assigned U.S. patent application Ser. No. 12/163,397 entitled "STRUCTURAL AND ACOUSTICAL VIBRATION DAMPENER FOR A ROTATABLE BLADE," filed Jun. 27, 2008, which is incorporated by reference herein in its entirety.

During operation of a fan assembly, the rotating drive unit may generate acoustical vibration energy or sound. This acoustical vibration energy may be transmitted through the driveshaft and the hub to the blades. In turn, the rotating blades may radiate high levels of acoustical vibration energy or sound, resulting in undesirable levels of audible noise.

For example, variable speed electrically-driven motors without resilient vibration isolators (also referred to as non-resilient rotor mounts) contain rotors and stators that are not isolated from each other. Consequently, acoustical vibration energy generated in a non-resiliently mounted electric drive motor is readily transmitted to the assembly to which the motor is attached. Thus, for example, during operation of a conventional fan assembly with a non-resiliently mounted electric drive motor, the acoustical vibration energy generated in the motor is transferred through the rotor, driveshaft and hub to the blades. In turn, the rotating blades radiate significantly high levels of acoustical vibration energy, producing undesirable audible noise that exceeds acceptable levels. The resulting vibration energy can also lead to vibration-induced material fatigue failure of the fan.

One method of reducing acoustical vibration energy, and the associated noise, in a conventional fan assembly is to isolate the rotor and stator in the electric drive motor used. However, this method increases the cost of the drive motor and may not adequately reduce the associated noise. Another method of reducing acoustical vibration energy in a fan assembly is to equip the drive motor with a vibration dampener to dissipate the acoustical vibration energy before it can be transmitted to the blades. However, this method reduces fan efficiency, increases cost, and may not adequately dampen or reduce the associated noise.

The present disclosure relates generally to apparatus and methods for dampening acoustical vibrations in a rotatable blade. More particularly, the present disclosure relates to an acoustical vibration dampener for a rotatable blade, which is susceptible to embodiments of different forms. There are shown in the drawings, and herein will be described in detail, specific embodiments of an acoustical vibration dampener for a rotatable blade and associated methods with the understanding that the disclosure is to be considered representative only and is not intended to limit the apparatus and methods to that illustrated and described herein. In particular, various embodiments of the acoustical vibration dampener are described in the context of a fan blade. However, these components may be used in any application where it is desired to reduce the audible noise of a rotating blade. Thus, an acoustical vibration dampener for a rotatable blade may be utilized in, for example, a turbine or an airboat, as well as a fan. It is to be fully recognized that the different teachings of the embodiments disclosed herein may be employed separately or in any suitable combination to produce desired results.

Figure 1B:
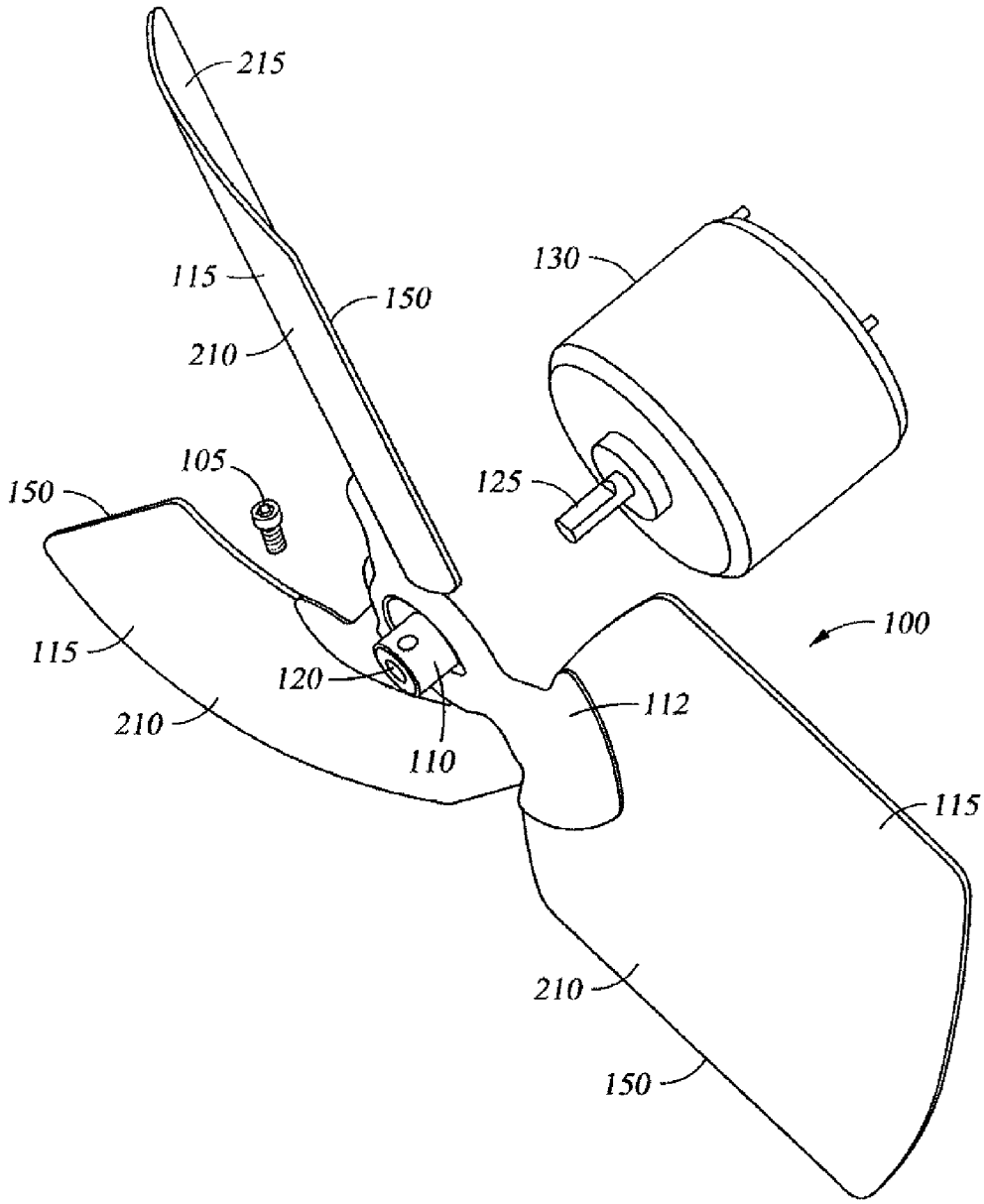
FIG. 1B is a schematic perspective view of the fan assembly of FIG. 1A, partially separated to depict its various components.

FIGS. 1A and 1B depict schematic perspective views of a fan 100 in assembled and partially disassembled form, respectively; the fan 100 comprising a plurality of blades 115, where each is a representative embodiment of a fan blade 115 with sections 210, 215 and with an acoustical vibration dampener 150 affixed to an opposing surface of each section 210, 215 and sandwiched therebetween. Blades 115 are coupled to a hub 110 by a spider 112. Hub 110 has an axial bore 120 therethrough, and a driveshaft 125 disposed partially within the axial bore 120 and coupled to the hub 110 by a set screw 105. A drive unit 130 is coupled to the driveshaft 125 and selectively operable to rotate the driveshaft 125. Drive unit 130 may comprise an electric motor or another type of motor, for example. In at least one embodiment, drive unit 130 is a variable speed electric rotor motor without a resilient vibration isolator, also referred to as a non-resiliently mounted motor. Due to the coupling of the driveshaft 125 and hub 110 via the set screw 105, rotation of the driveshaft 125 by the drive unit 130 also causes rotation of the hub 110, the spider 112 and the blades 115, thereby creating movement of the surrounding air.

Figure 2A:
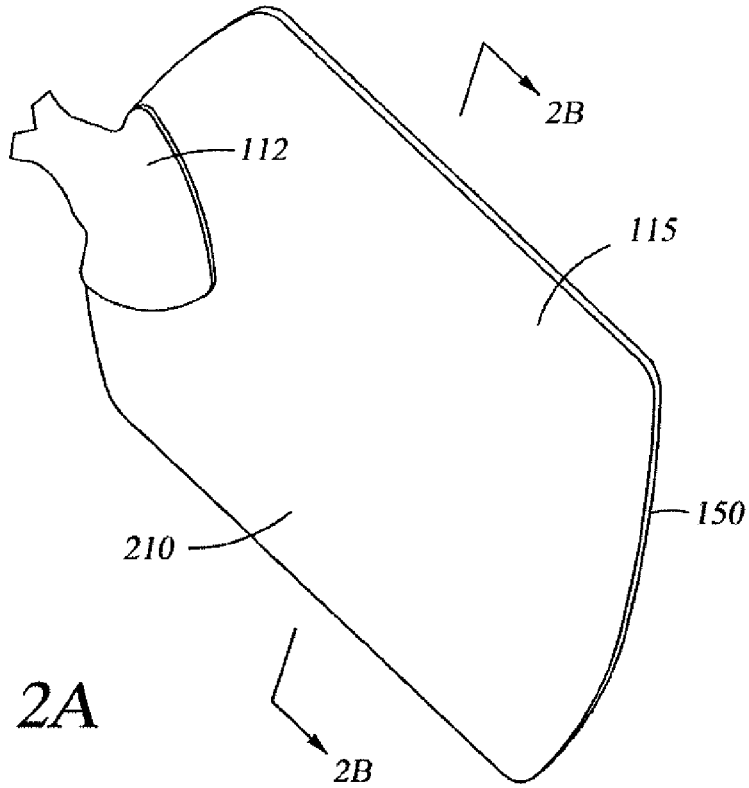
FIG. 2A is a schematic perspective view of a representative embodiment of a rotatable fan blade with an acoustical vibration dampener.
Figure 2B:
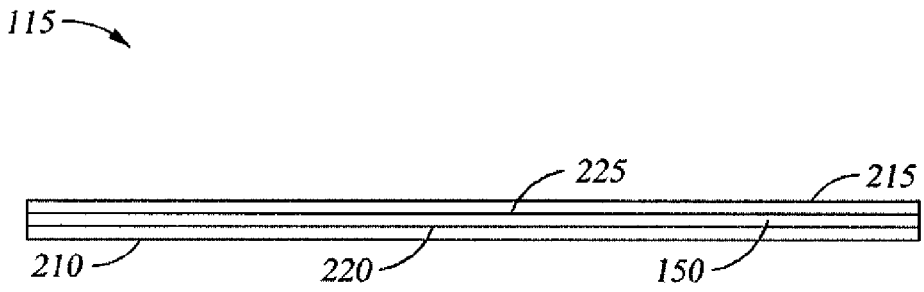
FIG. 2B is a schematic cross-sectional view of the fan blade of FIG. 2A taken along section line 2B-2B.

FIGS. 2A and 2B are schematic perspective and cross-sectional views, respectively, of a single blade 115 with sections 210, 215, each section 210, 215 including a respective opposing surface 220, 225, and an acoustical vibration dampener 150 affixed to surfaces 220, 225 of sections 210, 215 and sandwiched therebetween. Blade 115 may comprise a conventional fan blade formed of any suitable material, such as aluminum, steel, other metals, or plastics. Sections 210, 215 of blade 115 may be formed by separating a single blade into multiple sections. For example, sections 210, 215 may be formed by cutting or milling blade 115 into two sections. As another example, each section 210, 215 may be casted, molded, milled, machined, or otherwise formed separately as an integral unit, and sections 210, 215 may be combined or placed together to form a single blade. In one embodiment, acoustical vibration dampener 150 may extend the full length and width of blade 115, as illustrated in FIGS. 2A and 2B. In another embodiment, acoustical vibration dampener 150 may extend only partially within the full length and width of blade 115. Notably, the particular size, shape and orientation selected for acoustical vibration dampener 150 within blade 115 may comprise a design choice and may vary from one blade to another (e.g., within or outside of fan 100). Furthermore, each blade 115 may include more than one acoustical vibration dampener 150. For example, one or more acoustical vibration dampeners may be disposed generally parallel to acoustical vibration dampener 150 within blade 115. As another example, multiple acoustical vibration dampeners may be disposed generally parallel to one another within blade 115.

As illustrated more particularly by FIG. 2B, in an embodiment, acoustical vibration dampener 150 comprises a layer of acoustic damping material, shown coupled to each surface 220, 225 of sections 210, 215, respectively, and sandwiched therebetween. The acoustic damping material of acoustical vibration dampener 150 comprises a vibration damping, or energy absorbing, material, and in some embodiments may comprise viscoelastic adhesive material. An example of a suitable viscoelastic adhesive damping material is available from Materials Sciences Corporation (MSC). However, viscoelastic adhesive damping material from other suitable sources also may be used. In some embodiments, the acoustic damping material of acoustical vibration dampener 150 may comprise a resin, glue, or pressure-sensitive adhesive material with suitable acoustic damping properties. If the acoustic damping material of acoustical vibration dampener 150 has a pressure sensitive, adhesive property, acoustical vibration dampener 150 may adhere directly to each surface 220, 225 without the need for glue or another similar bonding material. A pressure-sensitive adhesive material with suitable acoustic damping properties is available from CSA Materials Corporation. In an embodiment, the acoustic damping material of acoustical vibration dampener 150 comprises adhesive material that securely affixes sections 210, 215 to acoustical vibration dampener 150 to form an integral blade. Also, in an embodiment, acoustical vibration dampener 150 comprises an adequate amount of vibration damping material to directly contact a substantial portion of each surface 220, 225 and maximize vibration damping thereto. For example, acoustical vibration dampener 150 may provide global damping in blade 115 that absorbs acoustical vibration energy over a broad range of frequencies and thereby suppresses a substantial amount of radiating sound.

In some embodiments, acoustical vibration dampener 150 and sections 210, 215 may comprise a constrained-layer damping system to achieve high damping and also maintain the structural integrity of acoustical vibration dampener 150. For example, sandwiching acoustical vibration dampener 150 between two constraining layers (sections 210, 215) protects acoustical vibration dampener 150 against undue deterioration (e.g., peeling away, delaminating, unbonding, ungluing, etc.). In some embodiments, acoustical vibration dampener 150 may comprise an engineered material designed with specific, predefined properties. An engineered material used to form acoustical vibration dampener 150 may be designed with predefined adhesive, acoustic dampening, and temperature properties to maintain the material's structural integrity, achieve high damping, and effectively reduce radiated noise. For example, a suitable material for acoustical vibration dampener 150 might be designed to last 10 years or so without appreciable structural or damping deterioration.

Figure 3:
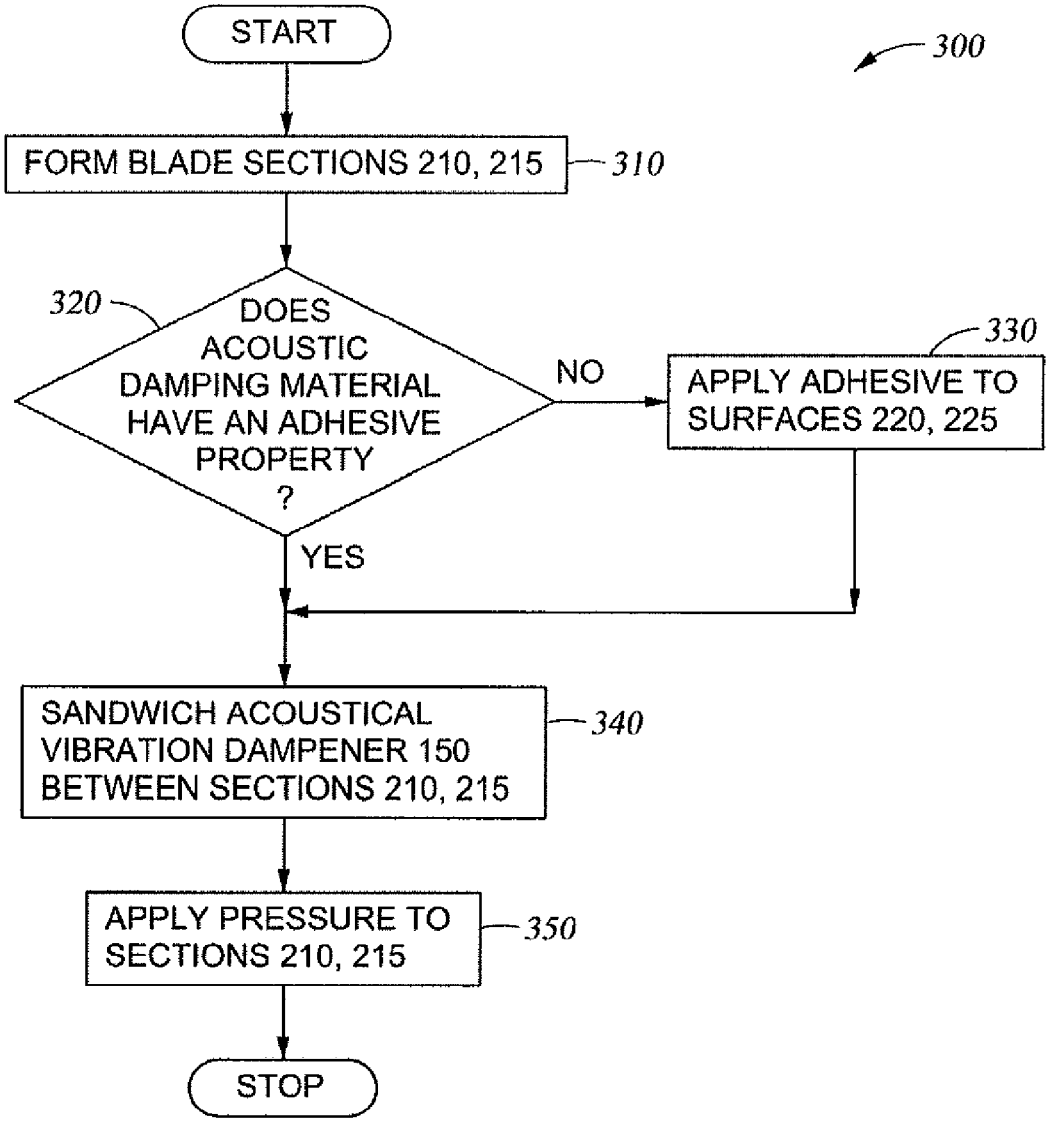
FIG. 3 is a flowchart of one representative method for constructing a rotatable fan blade with an acoustical vibration dampener.

FIG. 3 illustrates one example embodiment of a method 300 for constructing a fan blade 115 with an acoustical vibration dampener 150. The method begins at block 310 by forming two sections 210, 215 of a fan blade. For example, sections 210, 215 may be formed by separating, cutting or milling fan blade 115 into two corresponding pieces. As another example, each section 210, 215 may be formed by casting, molding, machining, or milling a separate integral piece. Next, at block 320, a determination is made about whether or not acoustical vibration dampener 150 comprises an acoustic damping material that has an adhesive property. If the acoustic damping material does not have an adhesive property, at block 330, glue, tape or other bonding material with an adhesive property may be applied to each surface 220, 225. Next, at block 340, acoustical vibration dampener 150 is disposed between or sandwiched between sections 210, 215. At block 350, pressure may be applied to each section 210, 215 to compress acoustical vibration dampener 150 therebetween and couple surfaces 220, 225 to the respective surfaces of acoustical vibration dampener 150.

In other embodiments, any other techniques or processes are contemplated whereby the fan blades are formed with at least some acoustic damping material provided between the sides or surfaces of the fan blade.

An acoustical vibration dampener in accordance with the principles disclosed herein may provide global damping to reduce the magnitude of sound pressure waves produced by a rotating blade, thereby suppressing the radiated noise.

While various embodiments of an acoustical vibration dampener and methods of constructing a rotatable blade with acoustical vibration dampening have been shown and described, modifications thereof can be made by one skilled in the art without departing from the spirit or teaching of this disclosure. The embodiments described herein are representative only and are not limiting. Many variations and modifications of the apparatus and methods are possible and are within the scope of the disclosure. Accordingly, the scope of protection is not limited to the embodiments described herein, but is only limited by the claims which follow, the scope of which shall include all equivalents of the subject matter of the claims.

What is claimed is:

1. An acoustical vibration dampening system for a rotatable blade, comprising:

a first section of a rotatable blade;

a second section of the rotatable blade; and a layer of acoustic damping material disposed between the first section and the second section so that the first section and the second section do not contact each other;

wherein the layer of acoustic damping material extends radially inward to at least partially radially overlap a portion of the rotatable blade configured for connection to a source of rotation.

2. The acoustical vibration dampening system of claim 1, wherein the acoustic damping material includes an adhesive property.

3. The acoustical vibration dampening system of claim 1, wherein the acoustic damping material comprises a viscoelastic material.

4. The acoustical vibration dampening system of claim 1, wherein the acoustic damping material comprises a glue material.

5. The acoustical vibration dampening system of claim 1, wherein the acoustic damping material comprises a bonding material.

6. The acoustical vibration dampening system of claim 1, wherein the acoustic damping material comprises a pressure-sensitive adhesive material.

7. The acoustical vibration dampening system of claim 1, wherein the acoustic damping material comprises a constrained-layer damping material.

8. The acoustical vibration dampening system of claim 1, wherein the rotatable blade is aluminum.

9. The acoustical vibration dampening system of claim 1, wherein the rotatable blade is steel.

10. The acoustical vibration dampening system of claim 1, wherein the rotatable blade is a plastic material.

11. The acoustical vibration dampening system of claim 1, wherein the acoustic damping material comprises an engineered material.

12. A fan blade comprising:

a first structural section of a fan blade;

a second structural section of the fan blade; and a layer of acoustic damping material provided between the first structural section and the second structural section of the fan blade so that the first structural section and the second structural section do not contact each other;

wherein the layer of acoustic damping material extends radially inward to at least partially radially overlap a portion of the rotatable blade configured for connection to a source of rotation.

13. The fan blade of claim 12, wherein the layer of acoustic damping material is coupled to a substantial portion of the first structural section and a substantial portion of the second structural section of the fan blade.

14. The fan blade of claim 12, wherein the layer of acoustic damping material adheres to the first structural section and the second structural section of the fan blade.

15. The fan blade of claim 12, wherein the first structural section and the second structural section comprise corresponding sections of a single blade.

16. The fan blade of claim 12, wherein the first structural section and the second structural section do not comprise corresponding sections of a single blade.

17. A method of making a fan blade with acoustic damping, comprising:

forming at least two sections of a fan blade;

disposing an acoustical vibration dampener between the at least two sections of the fan blade so that the at least two sections do not contact each other; and radially overlapping a portion of the acoustical vibration dampener with a portion of the fan blade configured for connection to a source of rotation.

18. The method of claim 17, wherein the forming comprises:

separating the fan blade into two corresponding sections.

19. The method of claim 17, wherein the forming comprises:

constructing the at least two sections of the fan blade.

20. The method of claim 17, wherein the disposing comprises:

adhering the acoustical vibration dampener to the at least two sections of the fan blade.

21. The method of claim 17, wherein the disposing comprises:

sandwiching the acoustical vibration dampener between the at least two sections of the fan blade.

* * * * *